US008251669B2

(12) United States Patent
Yeh et al.

(10) Patent No.: US 8,251,669 B2
(45) Date of Patent: Aug. 28, 2012

(54) COOLING FAN

(75) Inventors: Dung-Chang Yeh, Taipei Hsien (TW); Zhi-Ya Yang, Shenzhen (CN); Xue-Lian Suo, Shenzhen (CN); Ying-Liang Li, Shenzhen (CN); Song-Lin Ye, Shenzhen (CN); Yung-Ping Lin, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 367 days.

(21) Appl. No.: 12/697,305

(22) Filed: Feb. 1, 2010

(65) Prior Publication Data

US 2011/0135462 A1 Jun. 9, 2011

(30) Foreign Application Priority Data

Dec. 8, 2009 (CN) ..... 2009 1 0311062

(51) Int. Cl.
*F03B 3/12* (2006.01)
*F04D 29/38* (2006.01)

(52) U.S. Cl. ..... 416/228; 416/235; 416/236 R

(58) Field of Classification Search ..... 415/220; 416/228, 235, 236 R, 236 A
See application file for complete search history.

(56) References Cited

U.S. PATENT DOCUMENTS 6,517,315 B2 * 2/2003 Belady ..... 415/221
7,083,387 B2 * 8/2006 Chen et al. ..... 416/195

FOREIGN PATENT DOCUMENTS

GB 2050530 A * 1/1981

* cited by examiner

*Primary Examiner* — Dwayne J White
(74) *Attorney, Agent, or Firm* — Altis Law Group, Inc.

(57) ABSTRACT

A cooling fan includes a fan housing and a stator and an impeller received in the fan housing. The fan housing includes a frame and a mounting portion located in the frame. The stator is received in the frame and mounted to the mounting portion. The impeller is mounted to the stator and rotatable with respect to the stator. The impeller includes a hub and a plurality of blades extending radially and outwardly from the hub. Each of the blades includes an inner end connected with the hub and an outer end distant from the hub. Each of the blades forms a tab on the outer end at the end surface.

16 Claims, 4 Drawing Sheets

COOLING FAN

BACKGROUND

1. Technical Field

The present disclosure relates to cooling fans, and particularly to a cooling fan with little noise.

2. Description of Related Art

With continuing developments in technology, heat-generating electronic components such as CPUs (central processing units) provide improved performance such as faster processing speeds. However, such electronic components also tend to generate increased amounts of heat, which requires immediate dissipation. Often, a heat sink incorporating a cooling fan is employed to provide such heat dissipation. The heat sink absorbs heat from the electronic component and dissipates the heat to ambient air. The cooling fan provides airflow to the heat sink for removing the hot air from around the heat sink, thereby further facilitating cooling of the electronic component. However, the cooling fan frequently generates noise during operation.

Therefore, it is desirable to overcome the described limitations.

DETAILED DESCRIPTION

Figure 1:
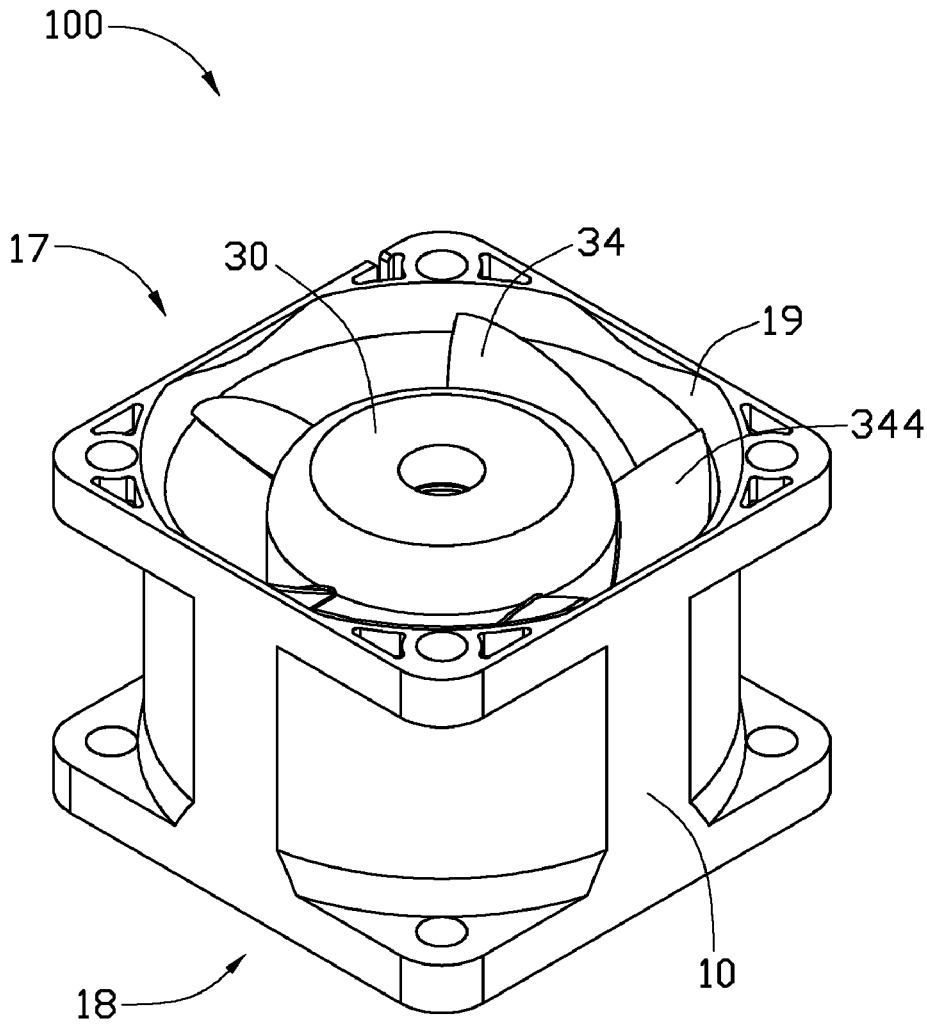
FIG. 1 is an assembled, isometric view of a cooling fan in accordance with an exemplary embodiment.
Figure 2:
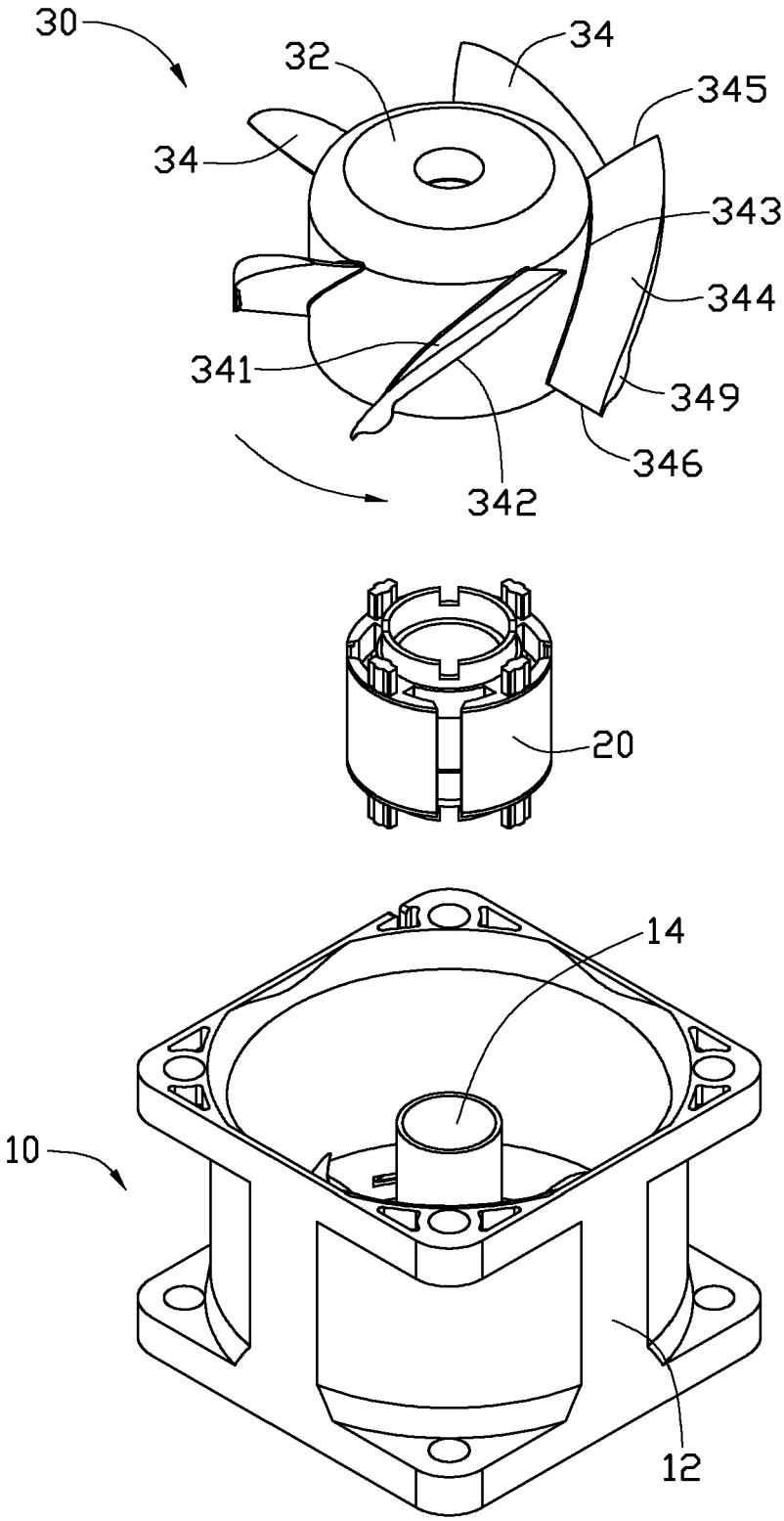
FIG. 2 is an exploded, isometric view of the cooling fan of FIG. 1.

FIGS. 1 and 2 show a cooling fan 100 according to an exemplary embodiment. The cooling fan 100 includes a fan housing 10, and a stator 20 and an impeller 30 received in the fan housing 10. An air inlet 17 is defined at a top side of the fan housing 10, and an air outlet 18 opposite to the air inlet 17 is defined at a bottom side of the fan housing 10. The fan housing 10 includes a hollow, square frame 12 and a mounting portion 14 formed in the frame 12 near the air outlet 18. The stator 20 is received in the frame 12 and mounted to the mounting portion 14. The impeller 30 is received in the frame 12 and rotatably mounted around the stator 20.

Figure 3:
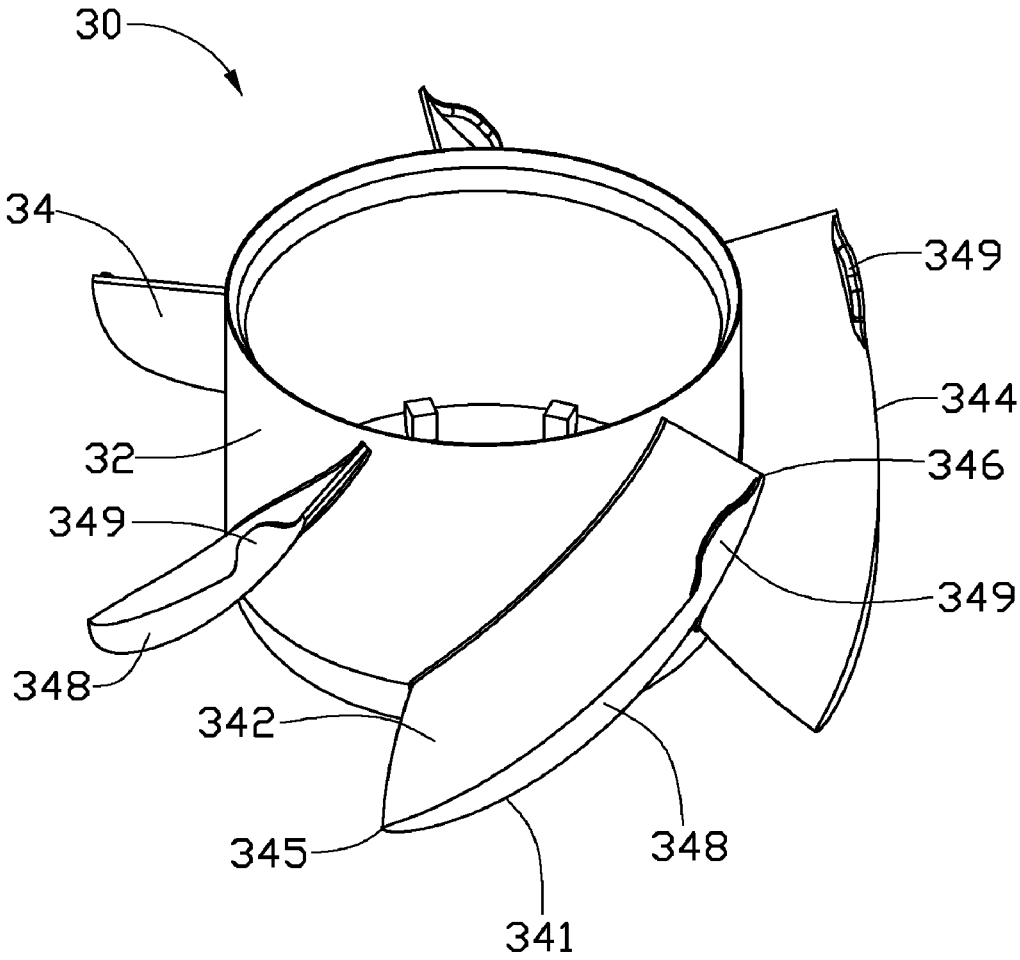
FIG. 3 is an isometric view of an impeller of the cooling fan of FIG. 2, showing the impeller inverted.

Referring also to FIG. 3, the impeller 24 includes a hub 32 and a plurality of blades 34 extending radially and outwardly from an outer periphery of the hub 32. Each blade 34 extends slantwise from an upper end to a lower end of the hub 32. The blade 34 includes a first surface 341 facing the air inlet 17 and an opposite second surface 342 facing the air outlet 18. The blade 34 also includes an inner end 343 connected with the hub 32 and an outer end 344 distant from the hub 32. The blade 34 forms an end surface 348 at the outer end 344 thereof. The end surface 348 connects the first surface 341 with the second surface 342 at the outer end 344 of the blade 34. The end surfaces 348 of the outer ends 344 of the blades 34 are evenly located along a circular path which is concentric with the hub 32. After the impeller 30 is received in the fan housing 10, the end surfaces 348 of the outer ends 344 of the blades 34 are spaced from an inner surface of the frame 12 of the fan housing 10, with a gap 19 defined therebetween.

Figure 4:
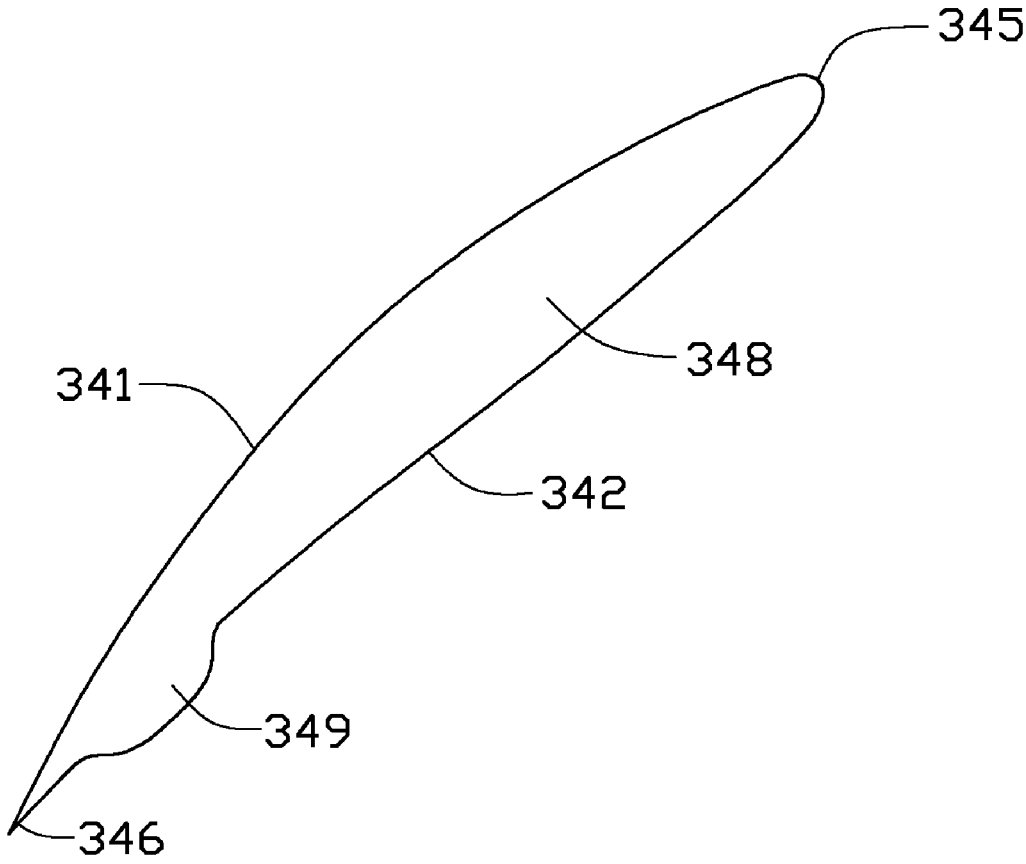
FIG. 4 is a plan view of an end surface of a blade of the impeller of FIG. 2.

Referring also to FIG. 4, the end surface 348 of the outer end 344 of each blade 34 has an airfoil shape. Each blade 34 includes a smooth top edge 345 and a sharp bottom edge 346. When air is driven by the impeller 30 to flow towards the air outlet 18 from the air inlet 17, the air reaches the top edge 345 first and the bottom edge 346 last. A thickness of the blade 34 as measured between the first surface 341 and the second surface 342 decreases from a middle portion thereof towards each of the top and bottom edges 345, 346 thereof. The top edge 345 is thicker than the bottom edge 346.

A tab 349 is perpendicularly formed on the outer end 344 of each blade 34 near the bottom edge 346. The tab 349 is substantially coplanar with the end surface 348. The tab 349 of each blade 34 protrudes from the outer end 344 of the blade 34 towards an adjacent leading blade 34 along a rotation direction of the impeller 30 during operation of the cooling fan 100. The tabs 349 of the blades 34 are located along the circular path of the end surfaces 348 of the outer ends 344 of the blades 34. The tabs 349 extend from the outer ends 344 along a same circumferential direction of the circular path. Each of the tabs 349 is substantially flat and has a curved leading edge. Thus, a protruding height of the tab 349 from the outer end 344 decreases from a middle of the tab 349 towards each of top and bottom sides of the tab 349. Alternatively, each tab 349 can have other shapes, such as a shape with a semicircular leading edge.

Each tab 349 is located at the end surface 348 between the middle portion of the blade 34 and the bottom edge 346 of the blade 34. A length of the tab 349 along the end surface 348 is less than a distance between the middle portion and the bottom edge 346 of the blade 34.

During operation of the cooling fan 100, the impeller 30 rotates with respect to the stator 20 and the blades 34 drive the air at the air inlet 17 to flow towards the air outlet 18. Accordingly, air pressure at the air inlet 17 is reduced and air pressure at the air outlet 18 is increased. As a result, the air pressure at the air outlet 18 exceeds that of the air inlet 17, and an air pressure differential is generated between the air above the first surface 341 of each blade 34 and the air under the second surface 342 of the blade 34. Thus, some of the air under the second surface 342 of the blade 34 tends to flow around the outer end 344 of the blade 34 to the first surface 341, and in turn escape away from the impeller 30 into the gap 19 between the impeller 30 and the fan housing 10, colliding with the frame 12 of the fan housing 10 and generating noise. The tab 349 formed at the end surface 348 of the blade 34 helps prevent the flow of air from under the second surface 342 to the first surface 341 and thereupon escaping away from impeller 30 to collide with the frame 12. Thereby, the tabs 349 of the blades 34 help reduce noise.

Maximum air pressure differential between the first surface 341 and the second surface 342 of each blade 34 exists near the bottom edge 346 of the blade 34. The positioning of the tab 349 near the bottom edge 346 reduces air leakage from the second surface 342 around the outer end 344 to the first surface 341 of the blade 34. Accordingly, noise generated by the cooling fan 100 during operation can be greatly reduced. Furthermore, the tab 349 divides the air under the second surface 342 into two airflows, which exit from the impeller 30 at different times and thus at different phases. The two airflows counteract such that noise of the cooling fan 100 is further reduced.

It is to be understood, however, that even though numerous characteristics and advantages of the exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cooling fan, comprising:

a fan housing comprising a frame and a mounting portion located in the frame;

a stator received in the frame and mounted to the mounting portion; and an impeller received in the frame and rotatably mounted relative to the stator, the impeller comprising a hub and a plurality of blades extending radially and outwardly from the hub, each of the blades comprising an inner end connected with the hub and an outer end distant from the hub, each of the blades forming a tab on the outer end at an end surface;

wherein the tab of each blade protrudes from the outer end of the blade towards an adjacent leading blade along a rotation direction of the impeller.

2. The cooling fan of claim 1, wherein the tab is substantially flat.

3. The cooling fan of claim 2, wherein the end surfaces of the outer ends of the blades are located along a circular path, the tabs located on and extending along a circumferential direction of the path.

4. The cooling fan of claim 1, wherein a protruding height of each of the tabs decreases from a middle of the tab to each of two opposite sides of the tab.

5. The cooling fan of claim 4, wherein each of the tabs has a curved leading edge.

6. The cooling fan of claim 1, wherein each of the tabs is substantially coplanar with the corresponding end surface.

7. The cooling fan of claim 1, wherein the fan housing defines an air inlet and an air outlet at two opposite sides thereof, and each of the blades has a top edge near the air inlet and a bottom edge near the air outlet.

8. The cooling fan of claim 7, wherein a thickness of each blade gradually decreases from a middle portion of the blade to each of the top and bottom edges of the blade, and the tab is located between the middle portion of the blade and the bottom edge of the blade.

9. The cooling fan of claim 8, wherein the tab is located at the end surface of the blade near the bottom edge of the blade.

10. The cooling fan of claim 8, wherein a length of the tab along the end surface is less than a distance between the middle portion of the blade and the bottom edge of the blade.

11. The cooling fan of claim 7, wherein each of the blades includes a first surface facing the air inlet and an opposite second surface facing the air outlet, and the end surface of the blade connects the first surface with the second surface at the outer end of the blade.

12. A cooling fan, comprising:

a fan housing comprising a frame and a mounting portion located in the frame;

a stator received in the frame and mounted to the mounting portion; and an impeller received in the frame and rotatably mounted relative to the stator, the impeller comprising a hub and a plurality of blades extending radially and outwardly from the hub, each of the blades comprising an inner end connected with the hub and an outer end distant from the hub, each of the blades forming a tab on the outer end at an end surface;

wherein a protruding height of each of the tabs decreases from a middle of the tab to each of two opposite sides of the tab.

13. The cooling fan of claim 12, wherein each of the tabs has a curved leading edge.

14. A cooling fan, comprising:

a fan housing comprising a frame and a mounting portion located in the frame;

a stator received in the frame and mounted to the mounting portion; and an impeller received in the frame and rotatably mounted relative to the stator, the impeller comprising a hub and a plurality of blades extending radially and outwardly from the hub, each of the blades comprising an inner end connected with the hub and an outer end distant from the hub, each of the blades forming a tab on the outer end at an end surface;

wherein the fan housing defines an air inlet and an air outlet at two opposite sides thereof, and each of the blades has a top edge near the air inlet and a bottom edge near the air outlet; and wherein a thickness of each blade gradually decreases from a middle portion of the blade to each of the top and bottom edges of the blade, and the tab is located between the middle portion of the blade and the bottom edge of the blade.

15. The cooling fan of claim 14, wherein the tab is located at the end surface of the blade near the bottom edge of the blade.

16. The cooling fan of claim 14, wherein a length of the tab along the end surface is less than a distance between the middle portion of the blade and the bottom edge of the blade.

* * * * *